US006247254B1

(12) United States Patent
Wessman

(10) Patent No.: US 6,247,254 B1
(45) Date of Patent: Jun. 19, 2001

(54) SNOW WINGS

(75) Inventor: Brian Wessman, 333 2nd Avenue Box 96, Cochrane, Ontario (CA), P0L 1C0

(73) Assignees: Brian Wessman; Denis Labelle

( * ) Notice: Subject to any disclaimer, the term of this patent is extended or adjusted under 35 U.S.C. 154(b) by 0 days.

(21) Appl. No.: 09/467,859

(22) Filed: Dec. 20, 1999

(30) Foreign Application Priority Data

Dec. 21, 1998 (CA) ..... 2256908

(51) Int. Cl.[7] ..... E01H 5/04
(52) U.S. Cl. ..... 37/256; 37/248
(58) Field of Search ..... 37/208, 212, 213, 37/214, 217, 223, 237, 238, 241, 242, 244, 248, 253, 256, 266, 274, 276, 321

(56) References Cited

U.S. PATENT DOCUMENTS 1,552,714 * 9/1925 Linzy ..... 37/248
1,594,095 * 7/1926 Fey et al. ..... 37/248
2,281,289 * 4/1942 Hewitt ..... 37/248

* cited by examiner

*Primary Examiner*—Robert E. Pezzuto
(74) *Attorney, Agent, or Firm*—Emch, Schaffer, Schaub & Porcello Co., L.P.A.

(57) ABSTRACT

A pair of wing assemblies for attachment to a snow thrower or snow blower employing an impeller within a housing and having a forward opening therein to facilitate the feeding of snow to the impeller. The wing assemblies are pivotally attached to the sides of the housing. In a first operative position, suitable for use after a light snowfall, the wings are positioned so as to diverge forwardly and thus increase the catchment area of the snow to be fed to the impeller, thereby improving the efficiency of operation of the snow thrower. In a second operative position, the wings are positioned so as to diverge rearwardly so as to push snow away from the snow thrower and increase the width of the path cleared. An inoperative third position with the wings folded laterally in front of the snow thrower permits compact storage of the snow thrower without having to remove the wing assemblies.

8 Claims, 2 Drawing Sheets

SNOW WINGS

BACKGROUND OF THE INVENTION

The present invention relates to a pair of wing assemblies for attachment to known snow clearing machines which employ an impeller, such as snow throwers for domestic use. Typically, the impeller is contained within a housing with a forward opening therein to facilitate the feeding of snow to the impeller as the snow thrower is operated.

DESCRIPTION OF THE PRIOR ART

The use of blades or wings in conjunction with a snow thrower is known. For example, Canadian Patent No. 671,590 granted to Worrel discloses a pair of forwardly extending side plates detachably connected to a snow thrower. A disadvantage of this type of blade, however, is that the flat design of the blades does not assist in scooping the snow and causing it to roll into the path of the impeller. A further disadvantage of this type of blade is that the fixed nature of the blades makes them inconvenient to attach or remove and ill-adapted to different snowfall conditions.

Another type of device, such as that disclosed in Canadian Patent No. 1,161,462 granted to Kelly, is an apparatus mounted onto the arms of a front end loader to scoop snow into an intake opening when the apparatus moves forward. Hydraulic rams are used to raise and lower wings to increase maneuverability of the vehicle. This type of device also suffers from being difficult to remove and attach and is limited to a single mode of operation.

SUMMARY OF THE INVENTION

Accordingly, it is desirable to be able to increase the utility and versatility of domestic snow clearing devices by providing the operator with a choice of modes of operation to better suit the task at hand while providing a simple, convenient and inexpensive positioning mechanism. It is also desirable to provide a shaped wing adapted to effectively scoop snow and feed it to the impeller of the snow thrower. It is further desirable to provide for the convenient storage of the snow clearing machine without the need to remove the wing assemblies.

The present invention provides for a pair of wing assemblies for attachment to snow removal equipment having a housing with a forward opening for feeding snow to an impeller, each wing assembly being attachable to an opposite side of the housing and comprising: a wing having a front surface, a back surface, and top, bottom and side edges, the front surface being concave about a horizontal axis; a locking arm having first and second end portions; and a rack having a front portion and a rear portion, the rack being fixed in a horizontal orientation to a side of the housing with the front portion proximate to the forward opening; a proximal side edge of the wing being pivotally connected to a front portion of the rack and a first end portion of the locking arm being pivotally connected to the back surface of the wing in spaced relation from the front portion of the rack so that the wing may move in a horizontal plane, a second end portion of the locking arm being capable of being selectively fixed to the rack in a plurality of positions so as to lock the wing in at least a first and a second operative position and the locking arm being capable of disengagement from the rack so as to permit the wing to assume an inoperative third position.

The present invention further provides for snow removal equipment having a housing with a forward opening for feeding snow to an impeller and provided with a wing assembly attached to each side of the housing, each wing assembly comprising: a wing having a front surface, a back surface, top, bottom and side edges, the front surface being concave about a horizontal axis; a locking arm having first and second end portions; and a rack having a front portion and a rear portion, the rack being fixed in a horizontal orientation to a side of the housing with the front portion proximate to the forward opening; a proximal side edge of the wing being pivotally connected to a front portion of the rack and a first end portion of the locking arm being pivotally connected to the back surface of the wing in spaced relation from the front portion of the rack so that the wing may move in a horizontal plane, a second end portion of the locking arm being capable of being selectively fixed to the rack in a plurality of positions so as to lock the wing in at least a first and a second operative position and the locking arm being capable of disengagement from the rack so as to permit the wing to assume an inoperative third position. Alternatively, the locking arm may be capable of disengagement from the wing so as to assume an inoperative storage position.

A single wing assembly is contemplated within the scope of the invention, for example, for the purposes of replacement parts. Accordingly, another aspect of the invention provides snow removal equipment having a housing with a forward opening for feeding snow to an impeller and provided with a wing assembly attached to each side of the housing, each wing assembly comprising: a wing having a front surface, a back surface, top, bottom and side edges, the front surface being concave about a horizontal axis; a locking arm having first and second end portions; and a rack having a front portion and a rear portion, the rack being fixed in a horizontal orientation to a side of the housing with the front portion proximate to the forward opening; a proximal side edge of the wing being pivotally connected to a front portion of the rack and a first end portion of the locking arm being pivotally connected to the back surface of the wing in spaced relation from the front portion of the rack so that the wing may move in a horizontal plane, a second end portion of the locking arm being capable of being selectively fixed to the rack in a plurality of positions so as to lock the wing in at least a first and a second operative position and the locking arm being capable of disengagement from the rack so as to permit the wing to assume an inoperative third position.

BRIEF DESCRIPTION OF THE DRAWINGS

The invention, as exemplified by a preferred embodiment, will now be described with reference to the drawings in which.

DETAILED DESCRIPTION OF THE PREFERRED EMBODIMENTS

Figure 1:
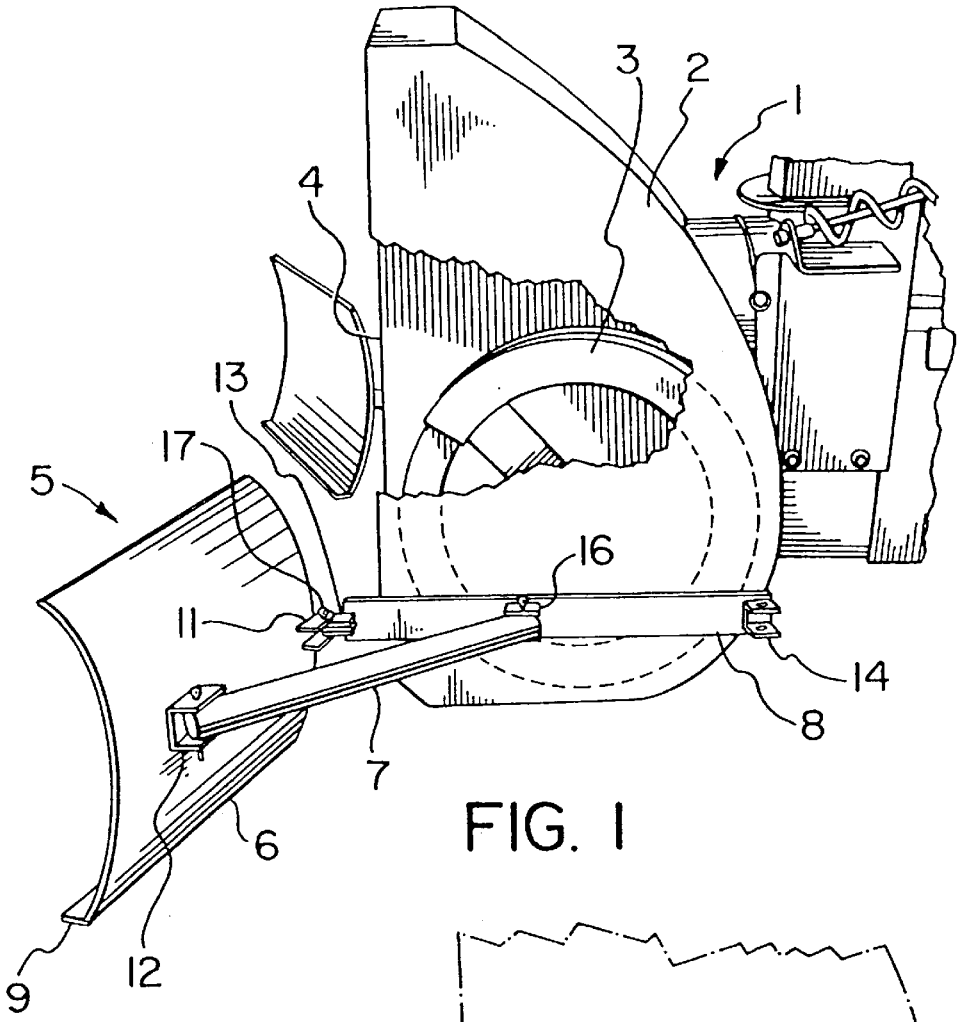
FIG. 1 is a side elevation view of a wing assembly shown as attached to a snow thrower.

As seen in FIG. 1, in the embodiment of the invention shown, a snow blower (1) has a housing (2) containing an impeller (3). Snow is fed to the impeller (3) via intake opening (4). A wing assembly (5) comprises a wing (6), a locking arm (7) and a rack (8).

The wing (6) is concave, when viewed from the side, in order to better channel snow into the intake opening (4). The wing may be made of plastic or metal, such as aluminum. The wing (6) is provided with an integral plate-like gliding member (9) which protrudes from the bottom edge of the wing (6) and is adapted to facilitate the gliding of the wing (6) along the ground. The gliding member (9) also serves, in cooperation with the concave shape of the wing (6), to gather snow and roll it into the intake opening (4). The width of the wing (6), measured from side to side, is slightly less than half the width of the intake opening (4) so as to facilitate convenient storage of the snow blower (1) with the wings (6) folded in a storage position.

The back surface of the wing (6) is provided with a first mounting bracket (11) at the proximal edge of the wing (6) and a first locking bracket (12) spaced from the first mounting bracket (11).

The racks (8) are mounted onto opposite sides of the housing (2) in a horizontal orientation using screws or bolts. Each rack (8) is provided at the end nearer the intake opening (4) with a second mounting bracket (13) to permit mounting of a wing (6) thereon. Each rack is also provided with a second locking bracket (14) near the other end of the rack and a third locking bracket (16) between the second mounting bracket (13) and the second locking bracket (14) in spaced apart relation from each.

The first mounting bracket (11) and the second mounting bracket (13) cooperate to form a hinge when secured with a first drop pin (17).

Figure 2:
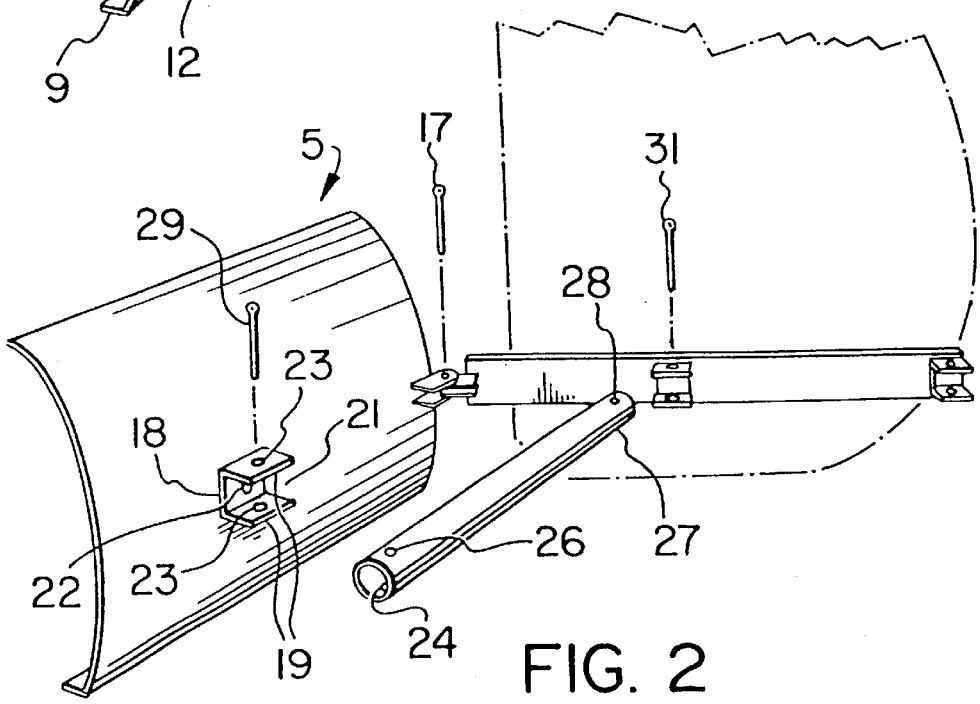
FIG. 2 is a perspective view showing details of the wing assembly.

As shown in FIGS. 1 and 2, the first, second and third locking brackets (12, 14, 16) are C-shaped, each having a flat middle portion (18) and flat end portions (19), the end portions (19) being perpendicular to the middle portion and parallel to each other so as to define a recess (21). The middle portion (18) is provided with a welding hole (22) to facilitate a weld mount. The end portions (19) are provided with centrally placed pin holes (23). The middle portion (18) of the first locking bracket (12) is fixed to the back of the wing (6) by fixing means, namely welding, so that the end portions (19) are horizontally oriented and disposed one above the other with pin holes (23) vertically aligned. The middle portion (18) of the first and second locking brackets (14, 16) are fixed to the rack (8) by fixing means, namely welding, so that the end portions (19) are horizontally oriented and disposed one above the other with pin holes (23) vertically aligned.

A first end portion (24) of the locking arm (7) is provided with a first hole (26) through the locking arm (7). A second end portion (27) of the locking arm (7) is provided with a second hole (28) through the locking arm (7) and parallel to the first hole (26). The first end portion (24) of the locking arm (7) is received in the recess (21) of the first locking bracket (12) so that the first hole (26) is aligned with pin holes (23) of the first locking bracket (12). A second drop pin (29) is inserted in the passage defined by the first hole (26) and pin holes (23) of the first locking bracket (12) thereby pivotally attaching the locking arm (7) to the wing (6), permitting rotation of the wing (6) in a horizontal plane. This movement is in the same plane as permitted by the hinge formed by the first mounting bracket (11) and the second mounting bracket (13).

Figure 3:
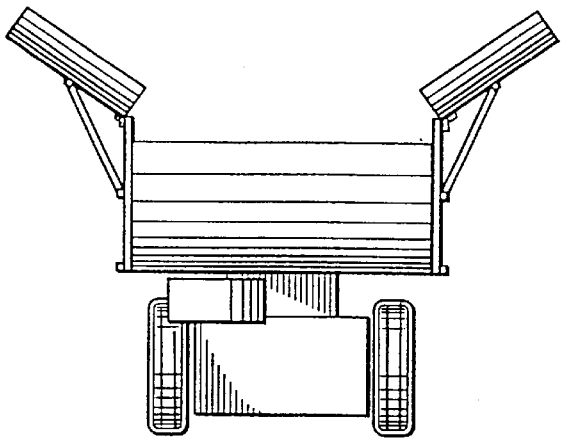
FIG. 3 is a plan view of the wing assembly in a first operative position.

In a first configuration, each locking arm assumes a first operative position wherein the second end portion (27) of each locking arm is attached to the respective third locking bracket (16) by receiving the second end portion (27) of the locking arm (7) in a recess (21) defined by the third locking bracket (16) so that the second hole (28) of the second end portion (27) of the locking arm (7) is aligned with the pin holes (23) of the third locking bracket (14) and inserting the third drop pin (31) through the passage thus defined. In this arrangement, the wing (6) is fixed and no longer permitted to move in a horizontal plane. The length of the locking arm (7) and the placement of the first and third locking brackets (12, 16) are such that the wing (6) is angled forwardly. In this preferred embodiment each wing (6) is angled at about 40 to 60 degrees, preferably approximately 45 degrees, from the side of the housing (2). Referring to FIG. 3, the pair of wings (6) thus diverge forwardly so as to increase the catchment area of the snow thrower and increasing the amount of snow fed to the impeller. This permits a mode of operation which is particularly suitable for use after a light snowfall to increase the efficiency of each pass thereby reducing the number of passes required.

Figure 4:
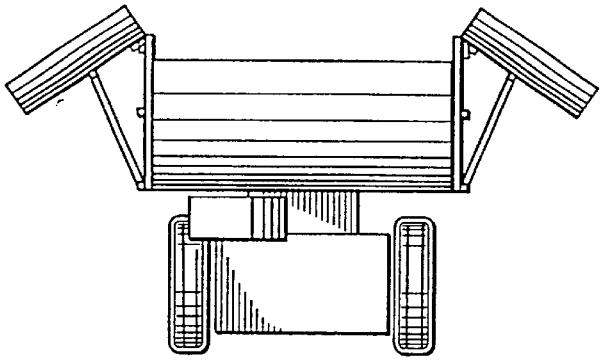
FIG. 4 is a plan view of the wing assembly in a second operative position.

In a second configuration, each locking arm assumes a second operative position wherein the second end portion (27) of each locking arm (7) is attached to the respective second locking bracket (14) by receiving the second end portion (27) of the locking arm (7) in a recess (21) defined by the second locking bracket (23) so that the second hole (28) of the second end portion (27) of the locking arm (7) is aligned with the pin holes (23) of the second locking bracket (14) and inserting the third drop pin (31) through the passage thus defined. In this arrangement, the wing (6) is fixed and no longer permitted arm (7) and the placement of the first and second locking brackets (12, 14) are such that the wing (6) is angled rearwardly. In this preferred embodiment each wing (6) is angled at about 40 to 60 degrees, preferably approximately 45 degrees, from the side of the housing (2). Referring to FIG. 4, the pair of wings (6) thus diverge rearwardly so as to form plows to augment the action of the impeller (3). Snow is conveniently pushed to the sides forming banks. This permits a mode of operation suitable for clearing a path through snow in a single pass that is wider than is possible using an unmodified snow thrower.

As an alternative to the first and second operative positions, a hybrid configuration may also be adopted in which a first wing (6) assumes a first operative position, as described above, so that it is angled forwardly and a second wing (6) assumes a second operative position, as described above, so that it is angled rearwardly. In this hybrid configuration, the first wing (6) acts to increase the amount of snow fed to the impeller (3) while the second wing (6) acts as a plow to augment the action of the impeller (3).

Figure 5:
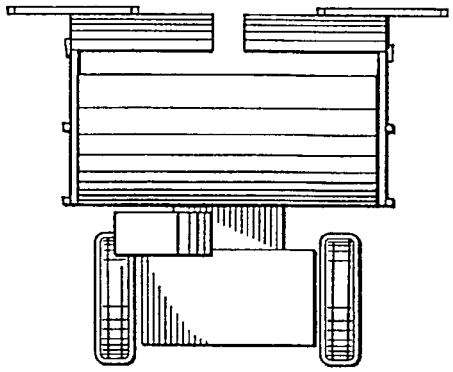
FIG. 5 is a plan view of the wing assembly in an inoperative third position.

Referring to FIG. 5, in a third configuration, each arm assumes an inoperative third position wherein each locking arm (7) is disengaged from the rack (8) by removing the third drop pin (31) and folding each locking arm (7) parallel and adjacent to the back surface of the wing (6) and folding each wing (6) in front of and perpendicular to the sides of the housing (2) of the snow thrower (1). This inoperative position thus facilitates storage of the snow thrower (1) mounted with wings (6) without the inconvenience of removing the wing assemblies (5). In this preferred embodiment, the concave shape of the wing (6) approximately follows the curvature of the impeller (3) so as to make the entire apparatus more compact.

An alternative inoperative storage position to that shown in FIG. 5 is a configuration wherein each locking arm (7) is disengaged from the wing (6) by removing the second drop pin (29) and folding each locking arm adjacent and parallel to a respective rack (8). Each wing (6) can then be folded in front of the snow thrower, as in FIG. 5, or alternatively, folded back so as to be adjacent and substantially parallel to a respective rack (8)

I claim:

1. A pair of wing assemblies for attachment to snow removal equipment having a housing with a forward opening for feeding snow to an impeller, said wing assemblies being attachable to opposite sides of the housing and capable of augmenting the feeding of snow to the impeller, each said wing assembly comprising:

a wing having a front surface, the front surface being concave about a horizontal axis;

a locking arm having first and second end portions, and a rack, attached to a side of the housing;

a proximal side edge of the wing being pivotally connected to the rack so that the wing may move in a horizontal plane and a first end portion of the locking arm being pivotally connected to the wing in spaced relation to the rack, a second end portion of the locking arm being capable of being selectively fixed to the rack by quick adjust means in a plurality of positions so as to lock the wing in at least a first and a second operative position and the locking arm being capable of disengagement through use of said quick adjust means from the wing or rack so as to permit the wing to assume an inoperative third position.

2. A pair of wing assemblies according to claim 1, wherein in the first operative position the wings are angled so as to diverge forwardly.

3. A pair of wing assemblies according to claim 1, wherein in the second operative position the wings are angled so as to diverge rearwardly.

4. A pair of wing assemblies according to claim 1, wherein in the inoperative third position the wings are folded across the forward opening of the housing of the snow removal equipment for compact storage thereof.

5. A pair of wing assemblies according to claim 1, wherein a first wing assumes the first operative position and is angled forwardly and a second wing assumes the second operative position and is angled rearwardly.

6. A pair of wing assemblies according to claim 1, wherein the bottom edge of each wing is provided with a gliding member adapted to facilitate movement of the wing along the ground.

7. Snow removal equipment having a housing with a forward opening for feeding snow to an impeller and provided with a wing assembly attached to each side of the housing and capable of augmenting the feeding of snow to the impeller, each said wing assembly comprising:

a wing having a front surface, the front surface being concave about a horizontal axis;

a locking arm having first and second end portions; and a rack, attached to a side of the housing;

a proximal side edge of the wing being pivotally connected to the rack so that the wing may move in a horizontal plane and a first end portion of the locking arm being pivotally connected to the wing in spaced relation to the rack, a second end portion of the locking arm being capable of being selectively fixed to the rack by quick adjust means in a plurality of positions so as to lock the wing in at least a first and a second operative position and the locking arm being capable of disengagement through use of said quick adjust means from the wing or rack so as to permit the wing to assume an inoperative third position.

8. A wing assembly for use with snow removal equipment having a housing with a forward opening for feeding snow to an impeller, the wing assembly being capable of attachment to the side of the housing and capable of augmenting the feeding of snow to the impeller, said wing assembly comprising:

a wing having a front surface, the front surface being concave about a horizontal axis;

a locking arm having first and second end portions; and a rack, attached to a side of the housing;

a proximal side edge of the wing being pivotally connected to the rack so that the wing may move in a horizontal plane and a first end portion of the locking arm being pivotally connected to the wing in spaced relation to the rack, a second end portion of the locking arm being capable of being selectively fixed to the rack by quick adjust means in a plurality of positions so as to lock the wing in a least a first and a second operative position and the locking arm being capable of disengagement through use of said quick adjust means from the wing or rack so as to permit the wing to assume an inoperative third position.

* * * * *